US010465686B2

(12) United States Patent
Dreifert et al.

(10) Patent No.: US 10,465,686 B2
(45) Date of Patent: Nov. 5, 2019

(54) VACUUM PUMP SYSTEM

(71) Applicant: Leybold GmbH, Köln (DE)

(72) Inventors: Thomas Dreifert, Kerpen (DE); Roland Müller, Köln (DE); Max Pelikan, Bornheim (DE); Dirk Schiller, Hürth (DE); Daniel Schneidenbach, Köln (DE); Dirk Stratmann, Bergheim (DE)

(73) Assignee: LEYBOLD GMBH, Cologne (DE)

( * ) Notice: Subject to any disclaimer, the term of this patent is extended or adjusted under 35 U.S.C. 154(b) by 0 days.

(21) Appl. No.: 15/320,169

(22) PCT Filed: Jun. 15, 2015

(86) PCT No.: PCT/EP2015/063287
§ 371 (c)(1),
(2) Date: Dec. 19, 2016

(87) PCT Pub. No.: WO2015/197396
PCT Pub. Date: Dec. 30, 2015

(65) Prior Publication Data

US 2017/0122319 A1 May 4, 2017

(30) Foreign Application Priority Data

Jun. 26, 2014 (DE) ..... 20 2014 005 279 U

(51) Int. Cl.
*F04C 18/12* (2006.01)
*F04C 18/16* (2006.01)
(Continued)

(52) U.S. Cl.
CPC ..... *F04C 23/005* (2013.01); *F04C 18/126* (2013.01); *F04C 18/16* (2013.01);
(Continued)

(58) Field of Classification Search
CPC ..... F04C 23/005; F04C 18/126; F04C 18/16; F04C 28/02; F04D 17/168; F04B 41/06; F04B 37/14
(Continued)

(56) References Cited

U.S. PATENT DOCUMENTS 4,504,201 A * 3/1985 Wycliffe ..... F04C 23/001 417/252
4,934,908 A * 6/1990 Turrell ..... F04C 23/001 418/3
(Continued)

FOREIGN PATENT DOCUMENTS

CN 1445459 A 10/2003
CN 1541307 A 10/2004
(Continued)

OTHER PUBLICATIONS

International Search Report dated Aug. 10, 2015 for PCT application No. PCT/EP2015/063287.

*Primary Examiner* — Mary Davis
*Assistant Examiner* — Deming Wan
(74) *Attorney, Agent, or Firm* — Ohlandt, Greeley, Ruggiero & Perle, LLP

(57) ABSTRACT

A vacuum pump system for evacuating a chamber, in particular a lock or a process chamber, is provided that includes a main vacuum pump preferably configured as a screw pump. An inlet of the main vacuum pump is connected with the chamber to be evacuated. As seen in the feeding direction of the main vacuum pump an auxiliary vacuum pump is arranged which is in particular a Roots pump. An outlet area of the main vacuum pump is connected with a main outlet on the one hand and an inlet of the
(Continued)

auxiliary vacuum pump on the other hand. Further, an outlet of the auxiliary vacuum pump is connected with the main outlet.

20 Claims, 2 Drawing Sheets

(51) Int. Cl.

| | |
|---|---|
| ***F04B 41/06*** | (2006.01) |
| ***F04B 37/14*** | (2006.01) |
| ***F04C 25/02*** | (2006.01) |
| ***F04C 28/02*** | (2006.01) |
| ***F04D 17/16*** | (2006.01) |
| ***F02M 37/04*** | (2006.01) |
| ***F04C 23/00*** | (2006.01) |
| ***F04C 28/26*** | (2006.01) |

(52) U.S. Cl.
CPC ..... *F04C 25/02* (2013.01); *F04C 28/26* (2013.01); *F04C 18/12* (2013.01); *F04C 28/02* (2013.01)

(58) Field of Classification Search
USPC ..... 418/5, 7, 8, 15, 3, 210, 219, 251, 286; 417/251, 287, 85
See application file for complete search history.

(56) References Cited

U.S. PATENT DOCUMENTS

| | | | | |
|---|---|---|---|---|
| 5,040,949 | A | 8/1991 | Crinquette et al. | |
| 5,564,907 | A * | 10/1996 | Maruyama | F04C 18/084 417/201 |
| 5,674,051 | A * | 10/1997 | Maruyama | F04C 23/001 417/3 |
| 6,379,135 | B2 | 4/2002 | Schofield | |
| 6,644,931 | B2 * | 11/2003 | Puech | F04B 37/14 417/199.1 |
| 7,140,846 | B2 * | 11/2006 | Yamamoto | F04C 23/001 417/245 |
| 7,611,340 | B2 * | 11/2009 | Hwang | F04C 18/084 418/200 |
| 2003/0068233 | A1 * | 4/2003 | Royce | F04B 37/14 417/251 |
| 2004/0173312 | A1 * | 9/2004 | Shibayama | F04C 23/001 156/345.29 |
| 2008/0145238 | A1 | 6/2008 | Shibayama et al. | |
| 2008/0166247 | A1 | 7/2008 | Holzemer | |
| 2011/0164992 | A1 | 7/2011 | Shibayama et al. | |
| 2012/0051948 | A1 | 3/2012 | Dirscherl et al. | |

FOREIGN PATENT DOCUMENTS

| | | | |
|---|---|---|---|
| CN | 102828652 | A | 12/2012 |
| DE | 69000990 | T2 | 6/1993 |
| DE | 102005008887 | A1 | 8/2006 |
| DE | 202009003980 | U1 | 8/2010 |
| DE | 102012220442 | A1 | 5/2014 |
| EP | 1130264 | A2 | 9/2001 |
| EP | 1536140 | A1 | 6/2005 |
| EP | 2423509 | A2 | 2/2012 |
| JP | H0333492 | A | 2/1991 |

* cited by examiner

VACUUM PUMP SYSTEM

BACKGROUND

1. Field of the Disclosure

The disclosure relates to a vacuum pump system.

2. Discussion of the Background Art

Vacuum pumps and vacuum pump systems are frequently used to evacuate chambers within a short time. This is effected using dry-compressing vacuum pumps, such as screw pumps, claw pumps or multistage Roots pumps. If required, oil-sealed vacuum pumps, such as rotary vane pumps or rotary piston pumps, can be used. Frequently a plurality of pumps are connected in series and/or in parallel in order to be able to pump large gas volumes within short time periods.

Typical applications are lock chambers such as provided in coating plants, for example. The lock chamber must be pumped down from atmospheric pressure to a transfer pressure within short periods of time. This is normally effected to a transfer pressure of 0.1 mbar to 10 mbar in time periods of 20 seconds to 120 seconds. Subsequently, a valve arranged between the lock chamber and the vacuum pump system can be closed. The valve is closed during an idle time of approximately one to ten times the pumping time.

Another typical application relates to large process chambers such as used for heat treatment or refinement of metals, for example. In this case of application typical pumping-out times are 2 minutes to 30 minutes. Following the pumping-out time the process chamber has reached the desired low pressure level. However, a relatively small process gas flow continues to flow such that a small gas flow must continuously be defined. This is a holding time which amounts to approximately two to ten times the pumping-out time.

Both lock chambers and correspondingly large process chambers require the vacuum pump system to have very large dimensions for realizing short pumping-out times. However, during the idle time and/or during the holding time the large suction capacities of the pump systems are not required. These lead to a high current draw and thus a high energy consumption.

For example, if a screw pump is used for evacuating a chamber, such as a lock chamber or a process chamber, the problem arises that between the rotor elements of the screw and the housing a gap is provided which is not sealed with a lubricant since this is a dry-compressed vacuum pump. The height of the gap in particular depends on the rotor temperature. Since the pumping medium constantly flows back through the gap, the optimum volumetric capacity of the pump is attained only when the operating temperature is reached and thus when the gap is very small. Once a set pressure is attained in a process chamber it would be possible, depending on the pump type, to reduce the rotational speed of the pump and thus the pumping capacity and to shut off the pump, if required. However, this is disadvantageous in that, once the pressure in the process chamber exceeds the set pressure again, first the pump must reach the operating temperature again before the full pumping capacity is attained. This would lead to inacceptable pressure variations in the process chamber. It is necessary that the vacuum pump is capable of immediately being operated at full pumping capacity again when a set pressure in the process chamber is exceeded to avoid an undesired increase of the pressure in the process chamber and excessive pressure variations in the process chamber.

In the case of lock chambers the pump must preferably be maintained at a nominal rotational speed since otherwise it would have to be accelerated at the end of the idle time. Thus the pumping-out process would be prolonged.

The problem that sealing gaps require the pump to be maintained at its operating temperature to guarantee a maximum volume flow also arises in other dry-compressing vacuum pumps, such as claw pumps, Roots pumps and the like.

To reduce the energy consumption of pumps and pump systems during the idle and/or the holding time different approaches are known:

It is possible to use vacuum pumps with a high installed volume ratio. However, the technically feasible volume ratios are limited by the manufacturing technology, the construction effort and the demands made on the robustness and tightness of the pump stages. In particular, only a small reduction of the energy consumption can thus be realized. In addition, solutions are required which avoid overcompression during pumping-out to a high internal compression.

In addition, a combination of forevacuum pumps with the series-connected Roots pump is known. This solution allows for a large volume ratio of the overall pump combination to be attained. However, it is disadvantageous that the Roots pump supports the forepump only to a small extent at high suction pressures of approximately 100 mbar, for example. This is due to the fact that otherwise a very large motor would have to be installed at the Roots pump and the pump would be subjected to a large thermal load.

It is an object of the disclosure to provide a vacuum pump system, wherein at different operating conditions on the one hand a high, in particular a maximum, volumetric capacity of the vacuum pump and/or the vacuum pump system can be guaranteed, and on the other hand the energy consumption can be reduced.

SUMMARY

The vacuum pump system according to the disclosure for evacuating a chamber, which is in particular a lock or a process chamber, comprises a main vacuum pump. The inlet of the main vacuum pump, which in a particularly preferred embodiment is a screw pump, is directly or indirectly connected with the chamber to be evacuated, wherein in a connecting line between the inlet of the main vacuum pump and the chamber to be evacuated a switchable valve may be arranged. The main vacuum pump has connected therewith an auxiliary vacuum pump arranged downstream in the direction of flow. The main vacuum chamber comprises at is outlet side an outlet area which is in particular a chamber and/or a space. This outlet area has connected therewith a main outlet on the one hand and an inlet of the auxiliary vacuum pump on the other hand. The outlet of the auxiliary vacuum pump is then connected with the main outlet.

Preferably, the auxiliary vacuum pump is a side channel pump and particularly preferably a Roots pump. Providing a Roots pump is particularly advantageous in that said pump only consumes a very small amount of energy during the holding time.

To prevent a medium, which has been pumped by the auxiliary vacuum pump into the main outlet, from flowing back to the outlet area of the main vacuum pump a check valve is arranged in the main outlet. This check valve is arranged at a location in the main outlet before the outlet of the auxiliary vacuum pump enters the main outlet, as seen in the direction of flow. The check valve may be a mechanical or a controllable and/or switchable check valve.

Preferably, the main vacuum pump, which is in particular a screw pump, and the auxiliary vacuum pump, which is in particular a Roots pump, are arranged in a common housing. This allows for a very compact design to be achieved. In addition, it is preferred that the pumps are connected with a common drive motor. Thus the manufacturing and the energy costs can be reduced.

In a particularly preferred embodiment, at least one feeder element of the main vacuum pump and at least one feeder element of the auxiliary vacuum pump are arranged on a common shaft. In particular when a screw pump is provided as the main vacuum pump and a Roots pump is provided as the auxiliary vacuum pump it is particularly preferred that the two feeder elements of the main vacuum pump together with a respective one of the two feeder elements of the auxiliary vacuum pump are arranged on a common shaft. This allows for a very compact and energy-saving design to be realized. Here, it is particularly preferred that the drive motor drives one of the two shafts and synchronous driving of the second shaft is guaranteed via an intermediate gearbox or directly meshing gears.

The main vacuum pump preferably comprises an internal compression of >2 and particularly preferably >3. The auxiliary vacuum pump does preferably not comprise any or comprises only a very small internal compression of in particular <2. It is particularly preferred that the auxiliary vacuum pump does not comprise any or comprises almost no internal compression. This facilitates the manufacture; an internal compression of the auxiliary vacuum pump is not worthwhile due to the large graduation towards the main pump.

In a preferred embodiment, the suction capacity of the auxiliary vacuum pump is smaller than 1/10, in particular smaller than 1/5 of the suction capacity of the main vacuum pump. This results in a high internal compression of the overall pump (main pump and auxiliary pump) and thus small power consumption.

Hereunder the disclosure is explained in greater detail on the basis of a preferred embodiment with reference to the appended drawing.

DETAILED DESCRIPTION OF THE PREFERRED EMBODIMENT

Figure 1:
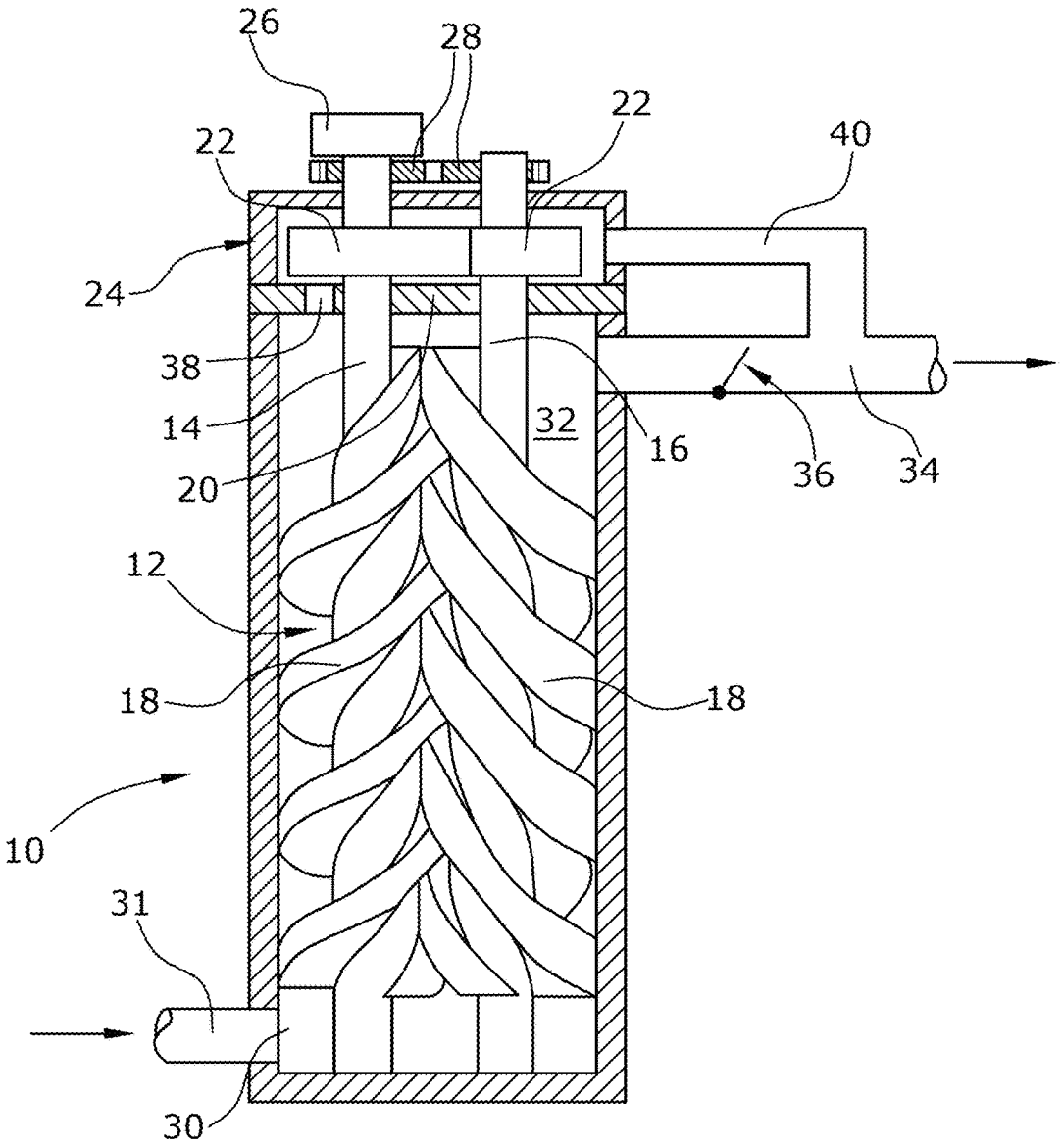
FIG. 1 shows a schematic sectional view of a preferred embodiment of the vacuum pump system according to the disclosure.

In FIG. 1, the schematic representation of a preferred embodiment of the disclosure a screw pump 12 is arranged in a common housing 10 is shown. The screw pump 12 comprises two helical rotor elements 18 respectively arranged on a rotor shaft 14, 16.

The two rotor shafts 14, 16 extend through an intermediate wall 20 of the housing, each carrying a rotor element 22 of a Roots pump 24.

The shaft 14 shown on the left-hand side in the drawing is further connected with an electric drive motor 26.

The electric motor 26 drives the shaft 14. The shaft 16 is driven via gears 28 which are respectively connected with one of the two shafts 14, 16.

For example, the inlet 30 of the main vacuum pump 12 is connected via a connecting line 31 with a chamber not shown which is to be evacuated. The screw pump 12 then feeds the medium to an outlet area 32 and/or an outlet chamber 32. From there the medium passes through the main outlet 34. In the main outlet 34 a check valve 36 is arranged.

In particular during holding operation a small volume of a medium is sucked in via an inlet 38 of the auxiliary vacuum pump 24 and ejected via an outlet 40 of the auxiliary vacuum pump. The outlet 40 is connected with the main outlet 34, wherein the connection is realized in the main outlet 34 downstream of the check valve 36 as seen in the direction of flow.

Figure 2:
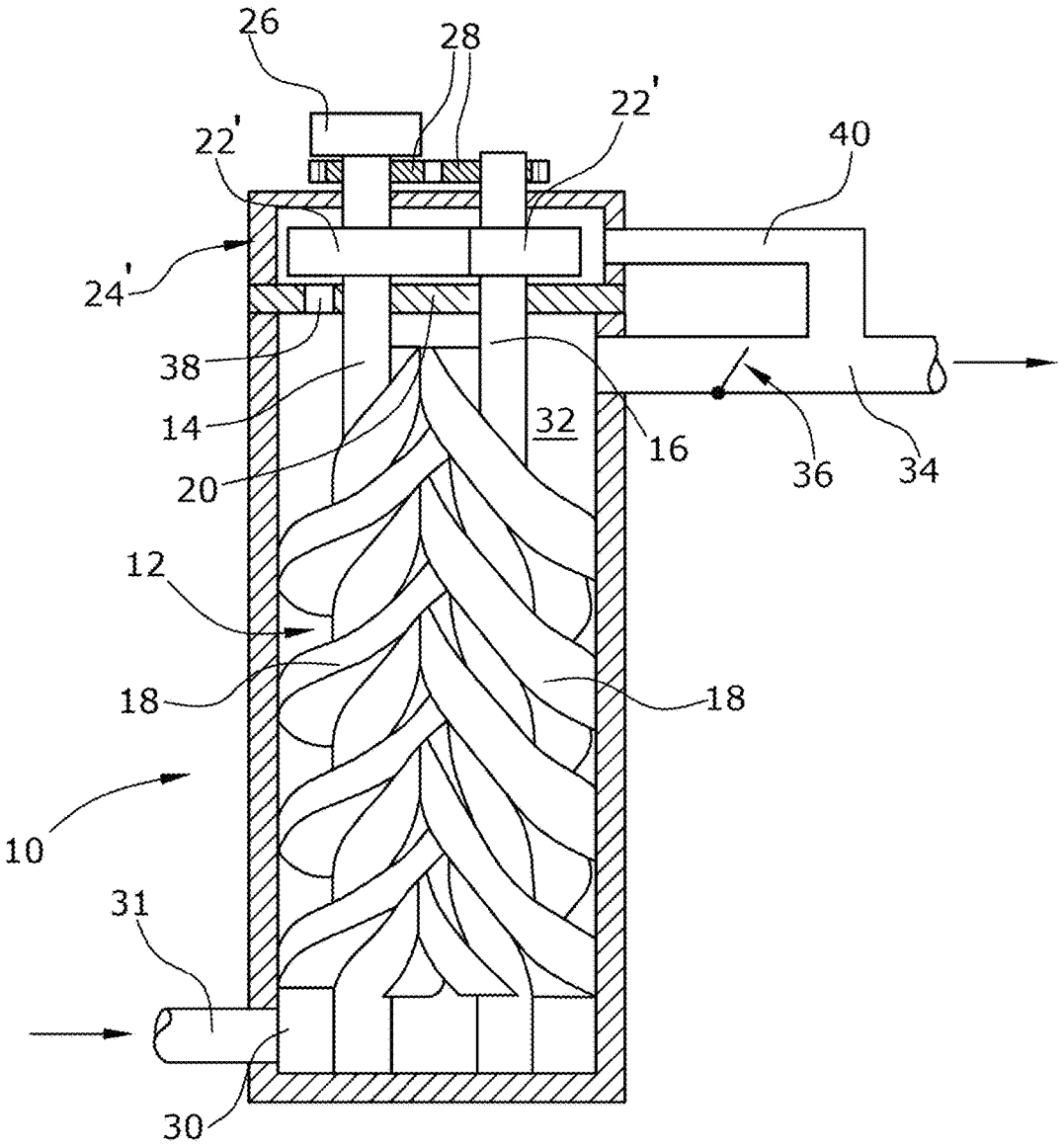
FIG. 2 shows a schematic sectional view of an alternate embodiment of the vacuum pump system according to the disclosure.

In FIG. 2, the schematic representation of an alternate embodiment of the disclosure a screw pump 12 is arranged in a common housing 10 is shown. Here, the two rotor shafts 14, 16 extend through an intermediate wall 20 of the housing, each carrying a pump elements 22' of a claw pump or a side channel pump 24'.

What is claimed is:

1. A vacuum pump system for evacuating a chamber, comprising:

a main vacuum pump whose inlet is connected with the chamber to be evacuated, an auxiliary vacuum pump downstream of said main vacuum pump as seen in the direction of flow, wherein said main vacuum pump comprises an outlet area which is connected with a main outlet on the one hand and an inlet of said auxiliary vacuum pump on the other hand, wherein an outlet of said auxiliary vacuum pump is connected with said main outlet, wherein the main vacuum pump is a screw pump, wherein the auxiliary vacuum pump is selected from a group consisting of a Roots pump, a claw pump, and a side channel pump, wherein a suction capacity of the auxiliary vacuum pump is smaller than one tenth of a suction capacity of the main vacuum pump, wherein at least one rotor element of the main vacuum pump and at least one rotor element of the auxiliary vacuum pump are arranged on a common shaft.

2. The vacuum pump system according to claim 1, wherein in the main outlet a check valve is arranged which prevents a medium from flowing back into the outlet area.

3. The vacuum pump system according to claim 2, wherein the outlet of the auxiliary vacuum pump is connected with the main outlet at a location downstream of the check valve.

4. The vacuum pump system according to claim 1, wherein the main vacuum pump and the auxiliary vacuum pump are arranged in a common housing.

5. The vacuum pump system according to claim 1, wherein the main vacuum pump and the auxiliary vacuum pump are connected with a common drive motor.

6. The vacuum pump system according to claim 1, wherein the main vacuum pump has two rotor elements and the auxiliary vacuum pump has two rotor elements, wherein one of the two rotor elements of the main and auxiliary vacuum pumps are respectively arranged on one common shaft, and wherein another of the two rotor elements of the main and auxiliary vacuum pumps are respectively arranged on a second common shaft.

7. The vacuum pump system according to claim 6, wherein the drive motor drives one of the two common shafts.

8. The vacuum pump system according to claim 1, wherein the main vacuum pump comprises an internal compression of at least >2.

9. The vacuum pump system according to claim 1, wherein the auxiliary vacuum pump comprises an internal compression of less than 2.

10. A vacuum pump system for evacuating a chamber, comprising:

a housing having an intermediate wall that divides the housing into a main region and an auxiliary region;

a main vacuum pump in the main region of the housing, the main vacuum pump having a main inlet into the main region from the chamber and a main outlet out of the housing, the main inlet being connected with the chamber to be evacuated; and an auxiliary vacuum pump in the auxiliary region of the housing, the auxiliary vacuum pump having an auxiliary inlet connected with the main region through the intermediate wall and an auxiliary outlet out of the housing, the auxiliary outlet being connected with the main outlet, wherein the main vacuum pump and the auxiliary vacuum pump are different types of pumps, wherein the main vacuum pump has two rotor elements and the auxiliary vacuum pump has two rotor elements, wherein one of the two rotor elements of the main and auxiliary vacuum pumps are respectively arranged on a first common shaft, and wherein another of the two rotor elements of the main and auxiliary vacuum pumps are respectively arranged on a second common shaft, wherein the main vacuum pump is a screw pump and the auxiliary vacuum pump is selected from a group consisting of a Roots pump, a claw pump, and a side channel pump.

11. The vacuum pump system according to claim 10, further comprising a check valve in the main outlet arranged to prevent flow back into the main vacuum pump.

12. The vacuum pump system according to claim 11, wherein the auxiliary outlet is connected with the main outlet downstream of the check valve.

13. The vacuum pump system according to claim 10, further comprising a drive motor outside of the housing and connected to the first common shaft.

14. The vacuum pump system according to claim 13, further comprising gears on the first and second common shafts outside of the housing, the gears being configured so that the drive motor also drives the second common shaft.

15. A vacuum pump system for evacuating a chamber, comprising:

a housing having an external wall and an intermediate wall, the intermediate wall dividing the housing into a main region and an auxiliary region, the external wall having a main inlet connecting the chamber and the main region, a main outlet connecting the main region and a region external to the housing, and an auxiliary outlet connecting the main region and the region external to the housing, the intermediate wall having an auxiliary inlet connecting the main and auxiliary regions;

a screw pump in the main region; and an auxiliary vacuum pump in the auxiliary region, the auxiliary vacuum pump consists of a Roots pump or a claw pump or a side channel pump; and a common shaft through the intermediate wall and the external wall in the auxiliary region, the common shaft driving both the screw pump and the auxiliary vacuum pump.

16. The vacuum pump system according to claim 15, wherein the screw pump has an internal compression of at least >2 and the auxiliary vacuum pump has an internal compression of less than 2.

17. The vacuum pump system according to claim 16, wherein the auxiliary vacuum pump has a suction capacity that is smaller than one tenth of a suction capacity of the screw pump.

18. The vacuum pump system according to claim 15, wherein the auxiliary vacuum pump has a suction capacity that is smaller than one tenth of a suction capacity of the screw pump.

19. The vacuum pump system according to claim 15, further comprising a check valve that prevents backflow through the main outlet.

20. The vacuum pump system according to claim 19, wherein the auxiliary outlet is connected with the main outlet downstream of the check valve.

* * * * *